US010837690B2

(12) United States Patent
Scalf

(10) Patent No.: US 10,837,690 B2
(45) Date of Patent: Nov. 17, 2020

(54) REFRIGERATOR ICEMAKING SYSTEM WITH TANDEM STORAGE BINS AND/OR REMOVABLE DISPENSER RECESS

(71) Applicant: Midea Group Co., Ltd., Foshan (CN)

(72) Inventor: Eric Scalf, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 124 days.

(21) Appl. No.: 15/836,035

(22) Filed: Dec. 8, 2017

(65) Prior Publication Data

US 2019/0178552 A1 Jun. 13, 2019

(51) Int. Cl.

| | |
|---|---|
| ***F25C 5/182*** | (2018.01) |
| ***F25C 5/20*** | (2018.01) |
| ***F25D 23/06*** | (2006.01) |
| ***F25D 11/02*** | (2006.01) |
| ***F25D 25/02*** | (2006.01) |
| ***F25C 5/187*** | (2018.01) |

(52) U.S. Cl.

CPC ..... *F25C 5/182* (2013.01); *F25C 5/187* (2013.01); *F25C 5/22* (2018.01); *F25D 11/02* (2013.01); *F25D 23/062* (2013.01); *F25D 25/025* (2013.01); *F25C 2400/10* (2013.01); *F25D 23/069* (2013.01)

(58) Field of Classification Search

CPC .. F25C 5/182; F25C 5/22; F25C 5/187; F25C 2400/10; F25D 23/062; F25D 11/02; F25D 23/069; F25D 25/025

USPC ..... 62/459

See application file for complete search history.

(56) References Cited

U.S. PATENT DOCUMENTS

| | | | | |
|---|---|---|---|---|
| 2,504,622 A * | 4/1950 | Band | F25D 23/126 222/162 |
| 2,869,714 A | 1/1959 | Williams | |
| 2,914,218 A | 11/1959 | Korodi | |
| 3,146,601 A * | 9/1964 | Gould | F25C 1/10 62/3.6 |
| 3,187,958 A | 6/1965 | Swart | |

(Continued)

FOREIGN PATENT DOCUMENTS

| | | |
|---|---|---|
| CN | 1648561 A | 8/2005 |
| CN | 1690621 A | 11/2005 |

(Continued)

OTHER PUBLICATIONS

International Search Report and Written Opinion issued in Application No. PCT/CN2018/074188 dated Aug. 20, 2018.

(Continued)

*Primary Examiner* — Paul Alvare
*Assistant Examiner* — Kirstin U Oswald
(74) *Attorney, Agent, or Firm* — Middleton Reutlinger

(57) ABSTRACT

A refrigerator utilizes in some instances an icemaker having a tandem arrangement of storage bins. A first storage bin receives ice produced by an icemaker and includes a reversible ice mover that when operated in a first direction feeds an ice dispenser, and when operated in a second direction feeds a second storage bin disposed below the first storage bin. A refrigerator may also in another aspect include an externally-accessible ice dispenser having a dispenser recess portion that is removable from the refrigerator when the doors of the refrigerator are closed, e.g., for the purpose of accessing an ice storage bin.

37 Claims, 9 Drawing Sheets

(56) References Cited

U.S. PATENT DOCUMENTS 3,218,111 A * 11/1965 Steiner ..... F25D 23/04 312/405.1
3,351,233 A * 11/1967 Chanoch ..... A47F 1/04 221/150 HC
3,602,007 A * 8/1971 Drieci ..... F25C 5/22 62/344
3,640,433 A * 2/1972 Rodth ..... B67D 1/107 222/129.2
3,643,464 A * 2/1972 Hilliker ..... F25C 1/24 62/344
3,744,270 A * 7/1973 Wilcox ..... F25D 25/025 62/344
3,785,512 A 1/1974 Gatz et al.
3,798,923 A * 3/1974 Pink ..... F25C 5/22 62/266
3,874,559 A * 4/1975 Pink ..... F25C 5/22 222/146.6
3,911,692 A * 10/1975 Maxwell ..... F25C 5/22 62/137
4,084,725 A * 4/1978 Buchser ..... F25C 5/22 221/75
4,129,015 A 12/1978 Morris, Jr.
4,168,805 A 9/1979 Taylor
4,189,063 A 2/1980 Matthiesen
4,227,383 A * 10/1980 Horvay ..... F25C 5/22 62/344
4,306,757 A * 12/1981 Horvay ..... F25C 5/22 312/292
4,333,612 A 6/1982 Hayashi
4,420,948 A * 12/1983 Savage ..... A23G 9/28 425/150
4,790,146 A * 12/1988 Mun ..... F25D 11/02 312/328
4,804,111 A 2/1989 Ricciardi et al.
4,942,983 A 7/1990 Bradbury
5,149,551 A 9/1992 Anderson
6,019,447 A * 2/2000 Jackovin ..... F25D 11/02 312/405
6,574,984 B1 6/2003 McCrea et al.
6,860,408 B2 3/2005 Hawkes
7,137,582 B1 11/2006 Mikkelsen et al.
7,188,479 B2 3/2007 Anselmino et al.
7,228,702 B2 6/2007 Maglinger et al.
7,284,390 B2 10/2007 Van Meter et al.
7,318,633 B2 * 1/2008 Shin ..... F25D 23/04 312/405
7,337,620 B2 3/2008 Coulter et al.
7,343,757 B2 3/2008 Egan et al.
7,386,992 B2 6/2008 Adamski et al.
7,455,085 B2 * 11/2008 Voglewede ..... F25D 23/126 141/18
7,475,562 B2 * 1/2009 Jackovin ..... F25D 11/02 62/344
7,493,774 B2 2/2009 Ferragut, II et al.
7,591,399 B2 9/2009 Hortin et al.
7,658,212 B2 2/2010 Meuleners et al.
7,673,471 B2 3/2010 Egan et al.
7,707,847 B2 5/2010 Davis et al.
7,712,321 B2 5/2010 Kadyk
7,997,452 B2 * 8/2011 Kim ..... F25D 23/028 222/182
8,001,796 B2 * 8/2011 Kim ..... F25D 23/12 62/66
8,006,502 B2 * 8/2011 Kim ..... F25C 5/22 62/66
8,191,378 B2 * 6/2012 Park ..... F25D 23/126 62/340
8,191,379 B2 6/2012 Wuesthoff et al.
8,196,618 B2 * 6/2012 Kim ..... F25C 5/22 141/82
8,201,715 B2 * 6/2012 Park ..... F25C 5/22 222/504
8,312,735 B2 * 11/2012 Fulton ..... F25D 23/126 62/344
8,336,330 B2 12/2012 Lee et al.
8,353,177 B2 1/2013 Adamski et al.
8,454,103 B2 * 6/2013 Jeon ..... F25D 23/028 312/405.1
8,499,577 B2 8/2013 Watson et al.
8,516,845 B2 8/2013 Wuesthoff et al.
8,459,055 B2 11/2013 Kim et al.
8,596,085 B2 12/2013 Koo et al.
8,656,731 B2 2/2014 Kim
8,701,428 B2 * 4/2014 Lee ..... B67D 1/0894 62/178
8,701,436 B2 * 4/2014 Kim ..... F25D 23/028 62/389
8,707,726 B2 4/2014 Lim et al.
8,733,123 B2 5/2014 Adamski et al.
8,756,952 B2 6/2014 Adamski et al.
8,806,884 B2 8/2014 Park et al.
9,068,772 B2 6/2015 Yeo et al.
9,085,453 B2 7/2015 McMahan et al.
9,284,179 B2 3/2016 Clancy et al.
9,476,631 B2 10/2016 Park et al.
9,593,875 B2 3/2017 Van Meter et al.
9,683,771 B2 6/2017 Anselmino et al.
9,791,198 B2 10/2017 Jeong et al.
10,119,747 B2 * 11/2018 You ..... F25D 23/025
2004/0007009 A1 1/2004 Wing et al.
2005/0178273 A1 * 8/2005 Meuleners ..... B67D 1/0858 99/279
2005/0268638 A1 * 12/2005 Voglewede ..... F25D 23/126 62/389
2006/0086132 A1 * 4/2006 Maglinger ..... F25D 11/02 62/344
2006/0090496 A1 5/2006 Adamski et al.
2006/0162369 A1 7/2006 Chae
2006/0272347 A1 12/2006 Park
2007/0033960 A1 * 2/2007 Egan ..... F25D 23/126 62/389
2007/0113578 A1 * 5/2007 Wu ..... F25C 5/182 62/344
2007/0204643 A1 * 9/2007 Harris ..... F25C 5/22 62/340
2008/0174220 A1 * 7/2008 Kim ..... F25D 23/028 312/405
2008/0272679 A1 * 11/2008 Wuesthoff ..... F25C 5/22 312/404
2008/0314065 A1 * 12/2008 Kim ..... F25D 23/028 62/389
2009/0008403 A1 * 1/2009 Lee ..... G07F 9/02 221/89
2009/0009042 A1 * 1/2009 Kim ..... F25D 23/126 312/405
2009/0031751 A1 2/2009 Ayvazoglu
2009/0229284 A1 * 9/2009 Fulton ..... F25D 23/126 62/137
2010/0037631 A1 2/2010 Choi et al.
2010/0050681 A1 3/2010 Ryu et al.
2010/0082159 A1 * 4/2010 Kim ..... F25C 5/22 700/275
2010/0293984 A1 11/2010 Adamski et al.
2011/0138821 A1 6/2011 Chase et al.
2011/0167862 A1 7/2011 Shin et al.
2011/0174008 A1 * 7/2011 Kim ..... F25D 23/126 62/264
2011/0239687 A1 * 10/2011 Lim ..... F25D 23/025 62/344
2012/0031136 A1 * 2/2012 Park ..... F25D 25/025 62/340
2012/0036882 A1 * 2/2012 Park ..... F25D 23/126 62/344
2012/0103002 A1 * 5/2012 Lee ..... F25D 23/02 62/389
2013/0263620 A1 10/2013 An et al.
2013/0263621 A1 10/2013 An et al.
2014/0000303 A1 * 1/2014 Jeong ..... F25O 5/22 62/344

(56) References Cited

U.S. PATENT DOCUMENTS

| | | | | |
|---|---|---|---|---|
| 2014/0251498 | A1* | 9/2014 | Park | F25D 23/126 141/258 |
| 2014/0252938 | A1 | 9/2014 | Kim et al. | |
| 2014/0285082 | A1* | 9/2014 | Choi | F25D 25/024 312/404 |
| 2016/0084560 | A1* | 3/2016 | Jeong | F25C 5/22 62/344 |
| 2016/0265816 | A1 | 9/2016 | Gillette et al. | |
| 2016/0341462 | A1 | 11/2016 | Kim | |
| 2016/0370102 | A1 | 12/2016 | Yang | |
| 2017/0082339 | A1 | 3/2017 | Adamski et al. | |
| 2017/0082340 | A1 | 3/2017 | Adamski et al. | |
| 2017/0138659 | A1 | 5/2017 | Lee et al. | |
| 2017/0167780 | A1 | 6/2017 | Jeong et al. | |
| 2017/0174493 | A1 | 6/2017 | Aranda et al. | |
| 2017/0292751 | A1 | 10/2017 | Lee et al. | |
| 2017/0314832 | A1 | 11/2017 | Kim | |
| 2018/0149408 | A1 | 5/2018 | Akca et al. | |

FOREIGN PATENT DOCUMENTS

| | | | |
|---|---|---|---|
| CN | 1811308 | A | 8/2006 |
| CN | 101650105 | A | 2/2010 |
| CN | 102575891 | A | 7/2012 |
| CN | 107314600 | A | 11/2017 |
| CN | 108931095 | A | 12/2018 |
| JP | 2001153525 | A2 | 6/2001 |
| KR | 20060074931 | A | 7/2006 |
| KR | 101123710 | B1 | 3/2012 |
| WO | 1997029330 | A1 | 8/1997 |
| WO | 2014086401 | A1 | 6/2014 |

OTHER PUBLICATIONS

International Search Report and Written Opinion issued in Application No. PCT/CN2018/074255 dated Aug. 29, 2018.
Transmittal of Related Applications.
Transmittal of Related Applications dated Dec. 14, 2018.
U.S. Patent and Trademark Office, Non-Final Office Action issued in U.S. Appl. No. 15/835,953 dated Feb. 26, 2020.
International Search Report and Written Opinion issued is Application No. PCT/CN2019/094349 dated Sep. 25, 2019.
U.S. Patent and Trademark Office, Office Action issued in U.S. Appl. No. 15/835,953 dated Sep. 4, 2020.
U.S. Patent and Trademark Office, Office Action issued in U.S. Appl. No. 16/215,005 dated Jun. 23, 2020.

* cited by examiner

REFRIGERATOR ICEMAKING SYSTEM WITH TANDEM STORAGE BINS AND/OR REMOVABLE DISPENSER RECESS

BACKGROUND

Residential refrigerators generally include both fresh food compartments and freezer compartments, with the former maintained at a temperature above freezing to store fresh foods and liquids, and the latter maintained at a temperature below freezing for longer-term storage of frozen foods. For many years, most refrigerators have fallen in to one of two categories. Top mount refrigerators, for example, include a freezer compartment near the top of the refrigerator, either accessible via a separate external door from the external door for the fresh food compartment, or accessible via an internal door within the fresh food compartment. Side-by-side refrigerators, on the other hand, orient the freezer and fresh food compartments next to one another and extending generally along most of the height of the refrigerator.

Door-mounted ice dispensers (which are often combined with water dispensers) are common convenience features on many of these residential refrigerators. Incorporating these features into top mount and side-by-side refrigerators has generally been straightforward because it is generally possible to mount such dispensers on the external door for the freezer compartment at a convenient height for a user, as well as at a location suitable for receiving ice produced by an ice maker mounted in the freezer compartment.

More recently, however, various types of bottom mount refrigerator designs have become more popular with consumers. Bottom mount refrigerators orient the freezer compartment below the fresh food compartment and near the bottom of the refrigerator. For most people, the fresh food compartment is accessed more frequently than the freezer compartment, so many of the items that a user accesses on a daily basis are accessible at a convenient height for the user. Some bottom mount refrigerators include a single door for each of the fresh food and freezer compartments, while other designs commonly referred to as "French door" refrigerators include a pair of side-by-side doors for the fresh food compartment. Some designs may also utilize sliding doors instead of hinged doors for the freezer compartment, and in some designs, multiple doors may be used for the freezer compartment.

Placing the freezer compartment at the bottom of a refrigerator, however, complicates the design of door-mounted ice dispensers, since every freezer compartment door is generally located too low for a door-mounted ice dispenser, and since placement of an ice dispenser on a fresh food compartment door orients the ice dispenser opposite the above-freezing fresh food compartment. Most ice dispensers rely at least in part on gravity to convey ice from an ice maker mold to a storage receptacle and/or to convey ice from the storage receptacle to an exit chute for the ice dispenser, so it is generally desirable to orient the ice maker at a higher elevation than the ice dispenser.

Moreover, while bottom mount refrigerators generally provide a relatively large fresh food compartment that extends the full width of the refrigerator, access to some food items maintained by shelves and/or bins may be difficult, particularly when many food items are stored in the refrigerator.

Accordingly, a need continues to exist in the art for an improved manner of providing externally-accessible ice dispensing, particularly within a bottom mount refrigerator, as well as of providing convenient access to food items stored in a refrigerator.

SUMMARY

The herein-described embodiments address these and other problems associated with the art by providing in one aspect a refrigerator that utilizes an icemaker having a tandem arrangement of storage bins. A first storage bin receives ice produced by an icemaker and includes a reversible ice mover that when operated in a first direction feeds an ice dispenser, and when operated in a second direction feeds a second storage bin disposed below the first storage bin. In addition, the herein-described embodiments address these and other problems associated with the art by providing in another aspect a refrigerator that includes an externally-accessible ice dispenser having a dispenser recess portion that is removable from the refrigerator when the doors of the refrigerator are closed, e.g., for the purpose of accessing an ice storage bin.

Therefore, consistent with one aspect of the invention, a refrigerator may include a cabinet, an icemaker disposed within the cabinet, a first storage bin disposed below the icemaker and configured to receive ice produced by the icemaker, a reversible ice mover disposed within the first storage bin and operable to move ice in first and second directions within the first storage bin, an ice dispenser configured to dispense ice disposed in the first storage bin, the ice dispenser configured to receive ice moved in the first direction by the reversible ice mover, and a second storage bin disposed below the first storage bin and configured to receive ice disposed in the first storage bin and moved in the second direction by the reversible ice mover.

In some embodiments, the reversible ice mover includes an auger or a conveyor. Also, in some embodiments, the first storage bin includes an aperture disposed proximate an opposite end of the first storage bin from the ice dispenser such that ice moved in the second direction by the reversible ice mover falls into the second storage bin through the aperture. Further, in some embodiments, the aperture is disposed in a bottom wall, a side wall, or an end wall of the first storage bin.

In some embodiments, the icemaker extends generally from front to back within the cabinet, where the ice dispenser is disposed on a front of the refrigerator, where the reversible ice mover moves ice in a generally forward direction when moving ice to the ice dispenser, and where the reversible ice mover moves ice in a generally rearward direction when moving ice to the second storage bin.

In addition, in some embodiments, the first and second storage bins are removable. In some embodiments, the second storage bin includes an ice bucket disposed within the second storage bin and removable therefrom. In addition, in some embodiments, the ice bucket includes at least one handle. Moreover, in some embodiments, the first and second storage bins are slidably removable. Some embodiments may also include at least one stop configured to restrict removal of the first storage bin beyond a stop position, and the first storage bin is configured to provide access to the icemaker and the reversible ice mover to clear an obstruction.

Some embodiments may further include a controller coupled to the reversible ice mover and a level sensor configured to sense a level of ice within the first storage bin, where the icemaker is positioned to drop ice into an intermediate area of the first storage bin, and where the controller is configured to, upon detecting a not full condition in the first storage bin with the level sensor, operate the reversible ice mover to move ice dropped into the intermediate area of the first storage bin in the first direction toward the ice dispenser, and upon detecting a full condition in the first storage bin with the level sensor, operate the reversible ice mover to move ice in the first storage bin in the second direction and into the second storage bin. Some embodiments may also include a second level sensor configured to sense a level of ice within the second storage bin, where the controller is further configured to inhibit a release of ice by the icemaker upon detecting a full condition in the first and second storage bins with the first and second level sensors.

In addition, some embodiments may also include a freezer compartment disposed in the cabinet, a fresh food compartment disposed in the cabinet above the freezer compartment and having a top wall, a bottom wall, and first and second side walls, the bottom wall separating the fresh food compartment from the freezer compartment, and an icemaking console extending upwardly from the bottom wall of the fresh food compartment only a portion of a height of the fresh food compartment and spaced apart from each of the top wall, the first side wall, and the second side wall, the icemaking console including one or more walls that insulate an interior compartment of the icemaking console from the fresh food compartment, where the icemaker, the first storage bin, the second storage bin, and the reversible ice mover are disposed within icemaking console.

In some embodiments, the ice dispenser is disposed on a front surface of the icemaking console. Moreover, in some embodiments, a first portion of the ice dispenser is disposed on a front surface of the first storage bin and a second portion of the ice dispenser is disposed on a front surface of the second storage bin. In addition, some embodiments may further include a dispenser control disposed on the front surface of the second storage bin. Some embodiments may also include a dispenser shut off circuit configured to deactivate the ice dispenser in response to movement of the second storage bin away from an operating position. In addition, some embodiments may also include a controller and a user control that activates the ice dispenser, where the dispenser shut off circuit includes at least one switch that disconnects the user control from the controller when the second storage bin is moved away from the operating position. Also, in some embodiments, the switch is a contact switch or a magnetic switch.

Consistent with another aspect of the invention, a refrigerator may include a cabinet including one or more food compartments, one or more doors coupled to the cabinet and configured to provide access to the one or more food compartments, an icemaker disposed within the cabinet, an externally-accessible ice dispenser configured to dispense ice produced by the icemaker when the one or more doors are closed, where the externally-accessible ice dispenser includes a dispenser recess portion configured to receive a container to which ice may be dispensed, and where the dispenser recess portion is removably mounted within the cabinet for removal from the cabinet when the one or more doors are closed.

Moreover, in some embodiments, the dispenser recess portion is slidably mounted within the cabinet. Some embodiments may further include an externally-accessible water dispenser coupled to a water supply and positioned to dispense water from the water supply through an outlet and into a container positioned below the outlet when the one or more doors are closed. Also, in some embodiments, the outlet of the externally-accessible water dispenser is fixedly mounted to the cabinet such that the outlet of the externally-accessible water dispenser remains in a fixed location on the cabinet when the dispenser recess portion is removed from the cabinet.

Further, in some embodiments, the externally-accessible water dispenser includes a user control configured to actuate the externally-accessible water dispenser. In some embodiments, the user control of the externally-accessible water dispenser is removably mounted within the cabinet. Also, in some embodiments, the externally-accessible ice dispenser includes a user control configured to actuate the externally-accessible ice dispenser. In some embodiments, the user control of the externally-accessible ice dispenser is mounted to the dispenser recess portion and is removable from the cabinet with the dispenser recess portion. Further, in some embodiments, the user control includes a paddle.

Some embodiments may also include a dispenser shut off circuit configured to deactivate the externally-accessible ice dispenser in response to removal of the dispenser recess portion from the cabinet. Some embodiments may further include a controller, where the dispenser shut off circuit includes at least one contact switch that disconnects the user control from the controller when the dispenser recess portion is removed from the cabinet.

In addition, some embodiments may further include a storage bin disposed below the icemaker and configured to receive ice produced by the icemaker, where the dispenser recess portion is coupled to the storage bin such that removal of the dispenser recess portion from the cabinet additionally removes the storage bin from the cabinet. In addition, in some embodiments, the storage bin is a second storage bin, and the refrigerator further includes a first storage bin disposed above the second storage bin and below the icemaker to receive ice produced by the icemaker, an ice chute disposed above the dispenser recess portion, and an ice mover disposed within the first storage bin and operable to move ice in the first storage bin to the ice chute when dispensing ice.

In some embodiments, the ice mover is reversible and operable to move ice in first and second directions within the first storage bin, where movement of the ice mover in the first direction moves ice to the ice chute and movement of the ice mover in the second direction drops ice from the first storage bin and into the second storage bin. In addition, in some embodiments, the first storage bin is slidably mounted within the cabinet for withdrawal from the cabinet when the one or more doors are closed.

Also, in some embodiments, the one or more food compartments includes a freezer compartment and a fresh food compartment, where the fresh food compartment is disposed in the cabinet above the freezer compartment and has a top wall, a bottom wall, and first and second side walls, where the bottom wall separates the fresh food compartment from the freezer compartment, where the refrigerator further includes an icemaking console extending upwardly from the bottom wall of the fresh food compartment only a portion of a height of the fresh food compartment and spaced apart from each of the top wall, the first side wall, and the second side wall, where the icemaking console includes one or more walls that insulate an interior compartment of the icemaking console from the fresh food compartment, and where the icemaker, the externally-accessible ice dispenser, and the dispenser recess portion are disposed within the icemaking console.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
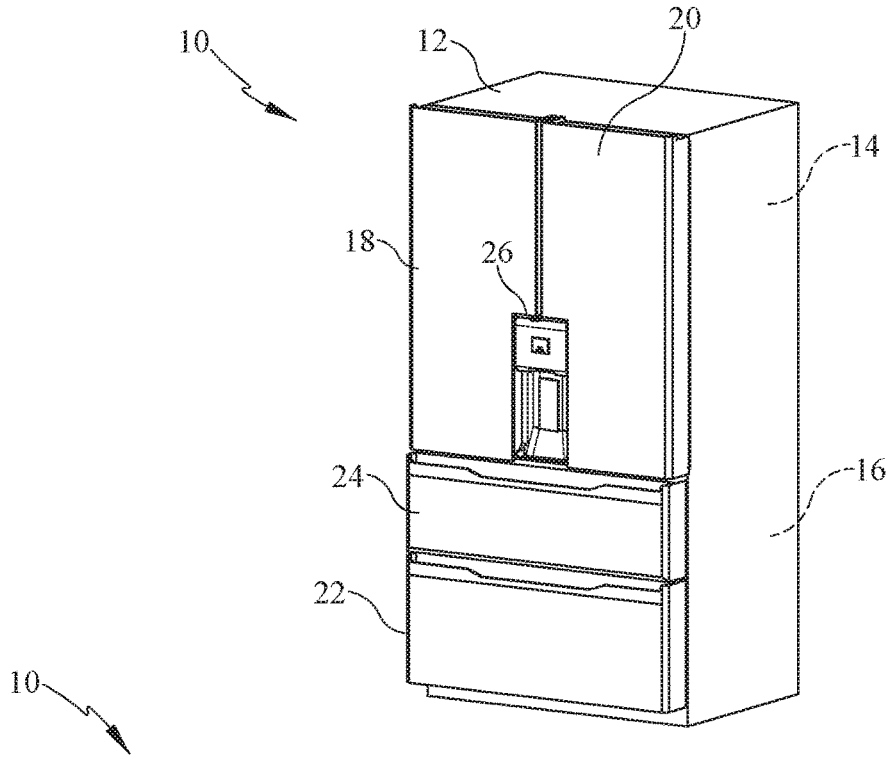
FIG. 1 is a perspective view of a refrigerator consistent with some embodiments of the invention.

Turning now to the drawings, wherein like numbers denote like parts throughout the several views, FIG. 1 illustrates an example refrigerator 10 in which the various technologies and techniques described herein may be implemented. Refrigerator 10 is a residential-type refrigerator, and as such includes a cabinet or case 12, a fresh food compartment 14, a freezer compartment 16, one or more fresh food compartment doors 18, 20 and one or more freezer compartment doors 22, 24.

Fresh food compartment 14 is generally maintained at a temperature above freezing for storing fresh food such as produce, drinks, eggs, condiments, lunchmeat, cheese, etc. Various shelves, drawers, and/or sub-compartments may be provided within fresh food compartment 14 for organizing foods, and it will be appreciated that some refrigerator designs may incorporate multiple fresh food compartments and/or zones that are maintained at different temperatures and/or at different humidity levels to optimize environmental conditions for different types of foods. Freezer compartment 16 is generally maintained at a temperature below freezing for longer-term storage of frozen foods, and may also include various shelves, drawers, and/or sub-compartments for organizing foods therein.

Refrigerator 10 as illustrated in FIG. 1 is a type of bottom mount refrigerator commonly referred to as a French door refrigerator, and includes a pair of side-by-side fresh food compartment doors 18, 20 that are hinged along the left and right sides of the refrigerator to provide a wide opening for accessing the fresh food compartment, as well as a pair of sliding freezer compartment doors 22, 24 that are similar to drawers and that pull out to provide access to items in the freezer compartment. Both the fresh food compartment and the freezer compartment may be considered to be full width as they extend substantially across the full width of the cabinet 12. It will be appreciated, however, that other door designs may be used in other embodiments, including various combinations and numbers of hinged and/or sliding doors for each of the fresh food and freezer compartments (e.g., a pair of French freezer doors, a single sliding freezer door, or one hinged fresh food and/or freezer door). Moreover, while refrigerator 10 is a bottom mount refrigerator with freezer compartment 16 disposed below fresh food compartment 14, the invention is not so limited, and as such, the principles and techniques may be used in connection with other types of refrigerators in other embodiments, e.g., top mount refrigerators, side-by-side refrigerators, etc.

Refrigerator 10 also includes a cabinet-mounted dispenser 26 for dispensing ice and/or water. In the illustrated embodiments, dispenser 26 is an ice and water dispenser capable of dispensing both ice and chilled water, while in other embodiments, dispenser 26 may be an ice only dispenser for dispensing only cubed and/or crushed ice. In still other embodiments, dispenser 26 may additionally dispense hot water, coffee, beverages, or other liquids, and may have variable and/or fast dispense capabilities. In some instances, ice and water may be dispensed from the same location, while in other instances separate locations may be provided in the dispenser for dispensing ice and water.

Figure 2:
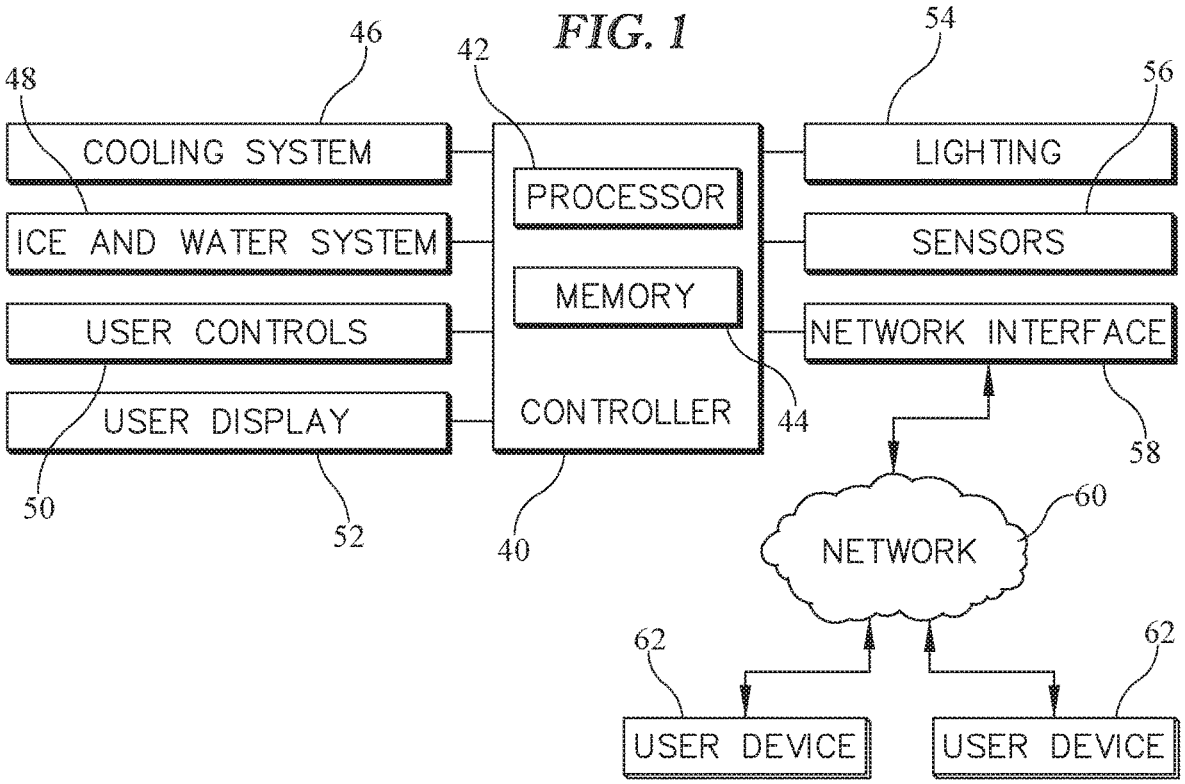
FIG. 2 is a block diagram of an example control system for the refrigerator of FIG. 1.

A refrigerator consistent with the invention also generally includes one or more controllers configured to control a refrigeration system as well as manage interaction with a user. FIG. 2, for example, illustrates an example embodiment of a refrigerator 10 including a controller 40 that receives inputs from a number of components and drives a number of components in response thereto. Controller 40 may, for example, include one or more processors 42 and a memory 44 within which may be stored program code for execution by the one or more processors. The memory may be embedded in controller 40, but may also be considered to include volatile and/or non-volatile memories, cache memories, flash memories, programmable read-only memories, read-only memories, etc., as well as memory storage physically located elsewhere from controller 40, e.g., in a mass storage device or on a remote computer interfaced with controller 40.

As shown in FIG. 2, controller 40 may be interfaced with various components, including a cooling or refrigeration system 46, an ice and water system 48, one or more user controls 50 for receiving user input (e.g., various combinations of switches, knobs, buttons, sliders, touchscreens or touch-sensitive displays, microphones or audio input devices, image capture devices, etc.), and one or more user displays 52 (including various indicators, graphical displays, textual displays, speakers, etc.), as well as various additional components suitable for use in a refrigerator, e.g., interior and/or exterior lighting 54, among others. User controls and/or user displays 50, 52 may be disposed, for example, on one or more control panels disposed in the interior and/or on doors and/or other external surfaces of the refrigerator. Further, in some embodiments audio feedback may be provided to a user via one or more speakers, and in some embodiments, user input may be received via a spoken or gesture-based interface. Additional user controls may also be provided elsewhere on refrigerator 10, e.g., within fresh food and/or freezer compartments 14, 16. In addition, refrigerator 10 may be controllable remotely, e.g., via a smartphone, tablet, personal digital assistant or other networked computing device, e.g., using a web interface or a dedicated app.

Controller 40 may also be interfaced with various sensors 56 located to sense environmental conditions inside of and/or external to refrigerator 10, e.g., one or more temperature sensors, humidity sensors, etc. Such sensors may be internal or external to refrigerator 10, and may be coupled wirelessly to controller 40 in some embodiments. Sensors 56 may also include additional types of sensors such as door switches, switches that sense when a portion of an ice dispenser has been removed, and other status sensors, as will become more apparent below.

In some embodiments, controller 40 may also be coupled to one or more network interfaces 58, e.g., for interfacing with external devices via wired and/or wireless networks such as Ethernet, Wi-Fi, Bluetooth, NFC, cellular and other suitable networks, collectively represented in FIG. 2 at 60. Network 60 may incorporate in some embodiments a home automation network, and various communication protocols may be supported, including various types of home automation communication protocols. In other embodiments, other wireless protocols, e.g., Wi-Fi or Bluetooth, may be used.

In some embodiments, refrigerator 10 may be interfaced with one or more user devices 62 over network 60, e.g., computers, tablets, smart phones, wearable devices, etc., and through which refrigerator 10 may be controlled and/or refrigerator 10 may provide user feedback.

In some embodiments, controller 40 may operate under the control of an operating system and may execute or otherwise rely upon various computer software applications, components, programs, objects, modules, data structures, etc. In addition, controller 40 may also incorporate hardware logic to implement some or all of the functionality disclosed herein. Further, in some embodiments, the sequences of operations performed by controller 40 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the refrigerator illustrated in FIGS. 1-2 will be apparent to one of ordinary skill in the art, as will become apparent from the description below. Therefore, the invention is not limited to the specific implementations discussed herein.

Icemaking Console

Figure 3:
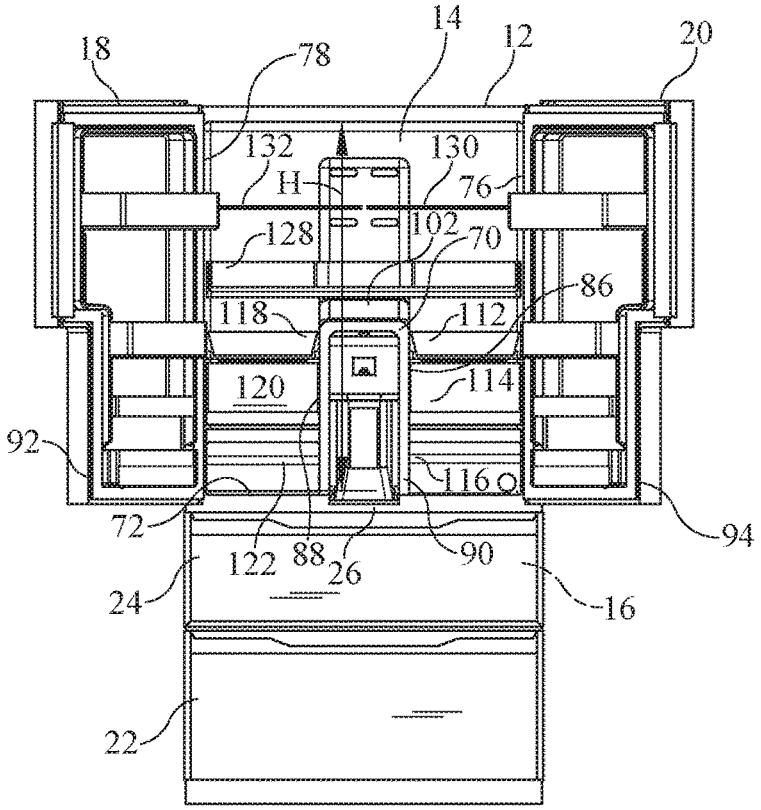
FIG. 3 is a front elevational view of the refrigerator of FIG. 1 with the fresh food compartment doors open.
Figure 4:
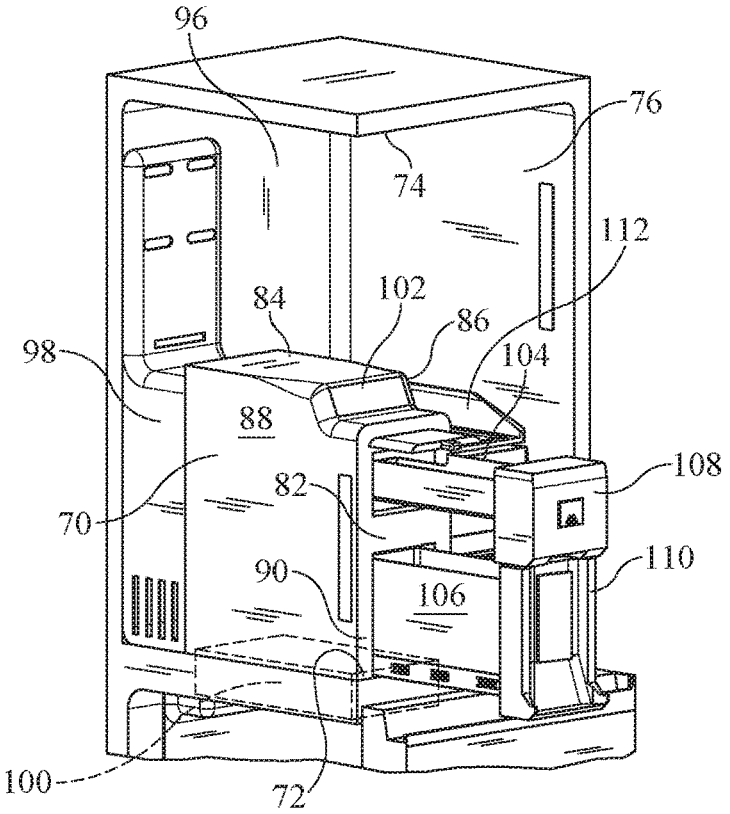
FIG. 4 is an exploded perspective view of the icemaking console for the refrigerator of FIG. 1.

Now turning to FIGS. 3 and 4, some embodiments consistent with the invention, as mentioned above, are directed in part to the use of an icemaking console disposed at least partially within a fresh food compartment and extending only a portion of the height of the fresh food compartment. In particular, an icemaking console 70 may be disposed in fresh food compartment 14 and may extend upwardly from a bottom wall 72 of the fresh food compartment 14 only a portion of a height H of the fresh food compartment and spaced apart from each of a top wall 74, right side wall 76, and left side wall 78 of the fresh food compartment. Console 70 may include a front wall 82, top wall 84, right side wall 86 and left side wall 88, and in some instances, at least portions of front wall 82 may be externally-accessible when doors 18, 20 are closed. In some instances, for example, front wall 82 may include a sealing surface 90 against which gaskets 92, 94 on doors 18, 20 may form a seal when doors 18, 20 are closed.

Console 70 may extend in some instances to a back wall 96 of fresh food compartment 14, while in other instances, and as shown in FIG. 4, a separate housing 98 may project from back wall 96 (e.g., formed integrally with back wall 96, or formed as a separate component that is fastened or otherwise attached to back wall 96). Housing 98 may be used, for example, to provide space for an evaporator and/or other cooling system component, for control electronics, for air ducts, or for other suitable purposes.

Moreover, the walls 82, 84, 86 and 88 of console 70 may be insulated (e.g., via foam or another suitable insulator) such that console 70 is an insulated console and such that an interior compartment of console 70 is maintained at a below-freezing temperature for the purposes of making and storing ice. In the illustrated embodiment, console 70 is in fluid communication with freezer compartment 16 through an opening 100 formed in bottom wall 72 of fresh food compartment 14, such that while console 70 is physically disposed within the boundary of fresh food compartment 14, the interior of console 70 is insulated from the fresh food compartment and in fluid communication with freezer compartment 16, thus effectively operating as an extension of freezer compartment 16. In other embodiments, console 70 may be separate from freezer compartment 16, e.g., insulated from freezer compartment 16 and including a separate cooling system, e.g., a thermoelectric cooling system, or separated from freezer compartment 16 but fluidly coupled via ducts or vents to receive cool air circulated by the freezer compartment cooling system.

Further, it will be appreciated that console 70 is formed separate from the shell or liner used to form the fresh food and/or freezer compartments. In other embodiments, however, console 70 may be formed integrally with the shell or liner of a fresh food and/or freezer compartment.

Console 70 in some embodiments may also provide a convenient location for a control panel 102 suitable for controlling various functions of refrigerator 10. For example, control panel 102 may include displays, buttons, sliders, switches, etc., and may be used to perform various control operations such as setting temperature setpoints, controlling ice and/or water functions, displaying alarms or alerts, etc. As shown in the illustrated embodiment, top wall 84 of console 70 may be bi-level to accommodate control panel 102, although in other embodiments, no control panel may be used, and top wall 84 may be at a substantially consistent elevation along its depth.

Console 70 in some instances may be an icemaking console insofar as the console is used to make, dispense and/or store ice. As will become more apparent below, however, console 70 may not be an icemaking console in some embodiments. In some embodiments, however, console 70 may be configured to receive one or more drawers or storage bins, e.g., upper and lower ice storage bins 104, 106. Upper ice storage bin 104 includes a front face 108 that insulates console 70 from the external environment when the bin is pushed into the console and forms a front surface of the upper ice storage bin, while lower ice storage bin 106 includes a front face 110 that similarly insulates console 70 from the external environment when the bin is pushed into the console and forms a front surface of the lower ice storage bin. Front faces 108, 110 also house at least a portion of an externally-accessible ice and water dispenser, discussed in greater detail below. In some embodiments, a single front face may be used, whereby the upper and lower ice storage bins may be coupled to the same front face.

Figure 5:
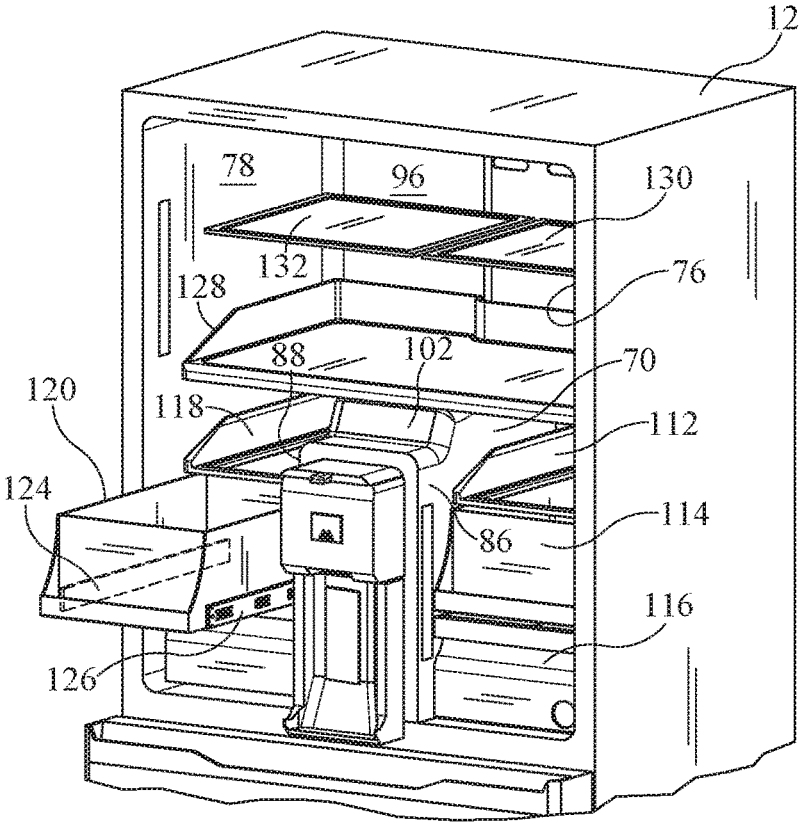
FIG. 5 is a perspective view of the refrigerator of FIG. 1, with the fresh food compartment doors removed, and with a storage bin in a fully extended position.

Beyond ice-related functions, however, console 70 also provides a number of structural features associated with the storage of food items within fresh food compartment 14. For example, as illustrated in FIG. 5, side walls 86, 88 of console 70 respectively face side walls 76, 78 of fresh food compartment 14, and may provide structural support for one or more sliding storage elements (e.g., storage elements 112, 114, 116, 118, 120, 122) within fresh food compartment 14. A storage element within the context of the disclosure may include any structural member capable of storing or otherwise supporting a food item, e.g., a shelf, a basket, a storage bin, a drawer, a rack, etc., and a sliding storage element may be considered to be a storage element capable of sliding within a horizontal plane, e.g., along a generally horizontal axis extending from the rear to the front of refrigerator 10.

Storage elements 112 and 118, for example, are sliding shelves, while storage elements 114, 116, 120 and 122 are sliding storage bins or drawers. It will also be appreciated that storage bins or drawers may be configured with customizable environmental conditions (e.g., different temperatures, humidity levels, etc.) suitable for storing food items such as meats, cheeses, vegetables, fruits, etc. Further, not all of storage elements 114-122 need be configured as sliding storage elements, and moreover, different numbers and types of storage elements may be used for any of the storage elements illustrated in FIG. 5, so the invention is not limited to the particular combination of storage elements illustrated herein.

Moreover, despite the fact that storage elements 112-122 are disposed within a full width fresh food compartment 14, console 70 provides greater support for these storage elements, so much so that in some embodiments it may be desirable to utilize full extension slide rails (e.g., slide rails 124, 126 for storage element 120) to support a sliding storage element, permitting the sliding storage element to be fully extended outwardly from the fresh food compartment, thereby providing greater access to the rear portion of the interior of a storage bin, drawer or basket, or to the rear portion of a shelf or rack. A full extension slide rail, in this regard, is configured to extend at least substantially the full depth of a sliding storage element, including overextension beyond the full depth of the sliding storage element in some embodiments.

Figure 6:
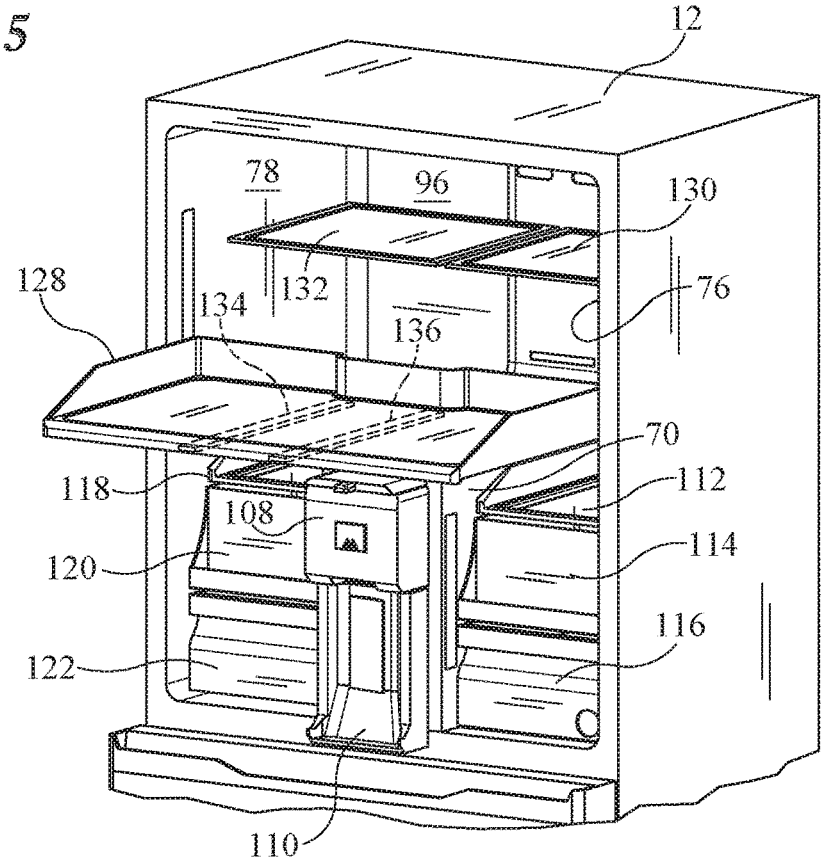
FIG. 6 is a perspective view of the refrigerator of FIG. 1, with the fresh food compartment doors removed, and with a full width shelf in a fully extended position.

Likewise, and with further reference to FIG. 6, console 70 may also provide structural support for storage elements located above the console, e.g., full width shelf 128, which is disposed underneath a pair of non-sliding shelves 130, 132 (which could also be sliding shelves in some embodiments as well). It will be appreciated that in conventional full width fresh food compartments, a full width shelf, extending substantially between the side walls of the fresh food compartment, would be exceptionally prone to sagging given the typical dimensions of such refrigerators. Moreover, configuring such a shelf to slide would generally strain any slide rails mounted to the side walls of the fresh food compartment, and adding full extension capability would provide even greater challenges.

In the illustrated embodiment, in contrast, top wall 84 of console 70 may provide adequate support for full width shelf 128 to enable a full width shelf to substantially span the entire width of fresh food compartment 14. In one embodiment illustrated in FIG. 6, for example, a pair of undermount slide rails 134, 136 (i.e., substantially horizontally oriented slide rails) support full width shelf 128 and extend along an underside thereof and generally parallel to one another. Further, in some embodiments, slide rails 134, 136 may be full extension slide rails to permit substantially full extension of full width shelf 128. Moreover, slide rails 134, 136 may provide sufficient support for full width shelf 128 to eliminate the need to support the shelf from side walls 76, 78, such that while the shelf extends substantially between the side walls of the fresh food compartment, the ends of the shelf do not necessarily contact or couple with the side walls themselves. Moreover, even if any additional storage elements are disposed underneath shelf 128 (e.g., storage elements 112 and 118), console 70 generally provides sufficient support such that shelf 128 need not be supported by any storage elements or other components disposed proximate the sides of the shelf.

Figure 7:
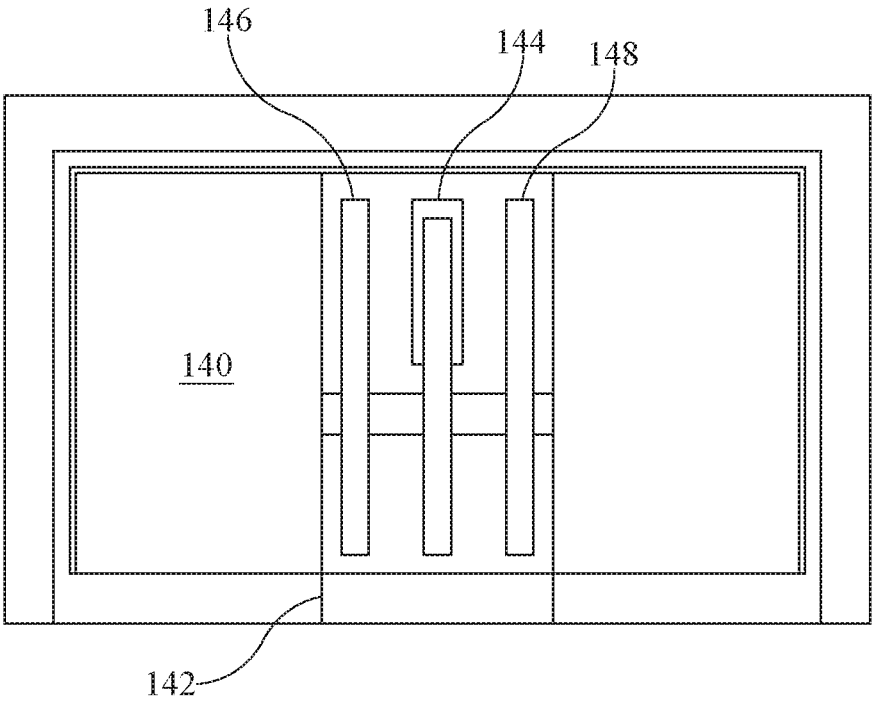
FIG. 7 is a functional top plan view of an alternate full width shelf support to that illustrated in FIG. 6.
Figure 8:
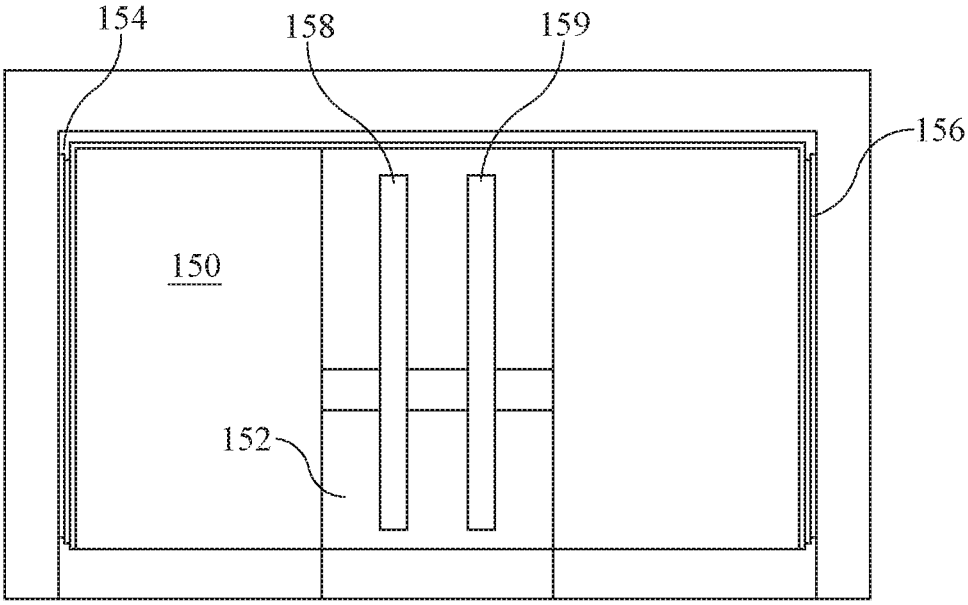
FIG. 8 is a functional top plan view of another alternate full width shelf support to that illustrated in FIG. 6.

Other manners of supporting full width shelf 128 may be used in other embodiments, including various combinations of undermount, top mount or side mount slide rails, glides (i.e., low friction tracks or surfaces), etc. FIG. 7, for example, illustrates a top view of an alternate full width shelf 140 supported by a console 142 using a single full extension undermount slide rail 144 and a pair of undermount glides 146, 148 extending generally parallel thereto. FIG. 8, as another example, illustrates a top view of an alternate full width shelf 150 supported by a console 152 using a pair of side wall mounted full extension slide rails 154, 156 and a pair of undermount glides 158, 159. Other combinations of components may be used to slidably support a full width shelf in other embodiments, as will be appreciated by those of ordinary skill in the art having the benefit of the instant disclosure.

As noted above, in the illustrated embodiment of FIGS. 1 and 3-6, console 70 extends upwardly from a bottom wall of a fresh food compartment of a bottom mount refrigerator only a portion of the height of the fresh food compartment, and further supports an externally-accessible ice and water dispenser that may be accessed without opening any door to the fresh food or freezer compartment. However, in other embodiments, various modifications may be used.

Figure 9:
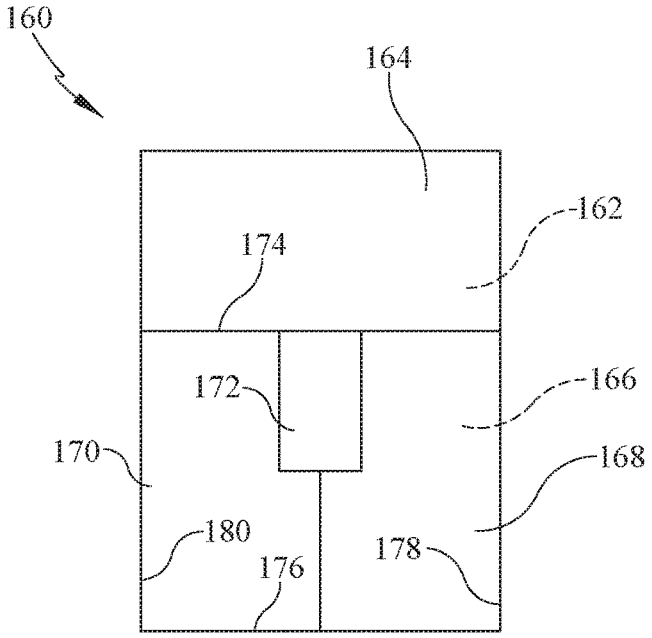
FIG. 9 is a functional front elevational view illustrating a top mount refrigerator utilizing an icemaking console consistent with some embodiments of the invention.

As shown in FIG. 9, for example, an icemaking console may extend downwardly rather than upwardly in some embodiments. The figure illustrates a top mount refrigerator 160 including a top mount freezer compartment 162 covered by a single freezer door 164 and disposed at a higher elevation from a fresh food compartment 166 covered by a pair of French doors 168, 170. In this design, an icemaking console 172 may extend downwardly from a dividing wall 174 that functions as a top wall for the fresh food compartment and separates fresh food compartment 166 from freezer compartment 162. However, the icemaking console 172 extends only a portion of the height of fresh food compartment 166, and is thus separated from an end wall 176 and side walls 178, 180 of the fresh food compartment. French doors 168, 170 also have cut-outs such that console 172 is externally-accessible without opening any of doors 164, 168 and 170.

Figure 10:
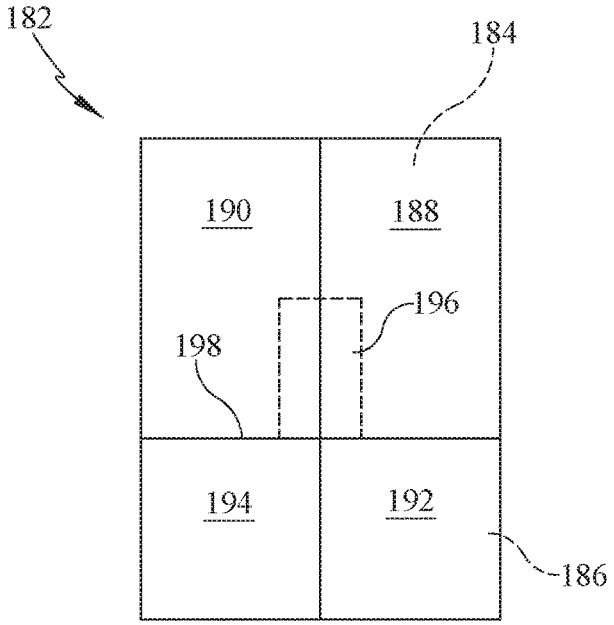
FIG. 10 is a functional front elevational view illustrating a bottom mount refrigerator utilizing an icemaking console covered by the fresh food compartment doors consistent with some embodiments of the invention.

As shown in FIG. 10, an icemaking console may not be externally-accessible in some embodiments, and may be covered by one or more of the fresh food and/or freezer doors. The figure illustrates a bottom mount refrigerator 182 that includes a fresh food compartment 184 at a higher elevation than a freezer compartment 186, with each compartment 184, 186 covered by a pair of French doors 188, 190 and 192, 194. An icemaking console 196 extends upwardly from a dividing wall 198 separating the fresh food and freezer compartments; however, no cut-outs are provided on any of the doors such that console 196 is only accessible by opening one or more of doors 188-194.

Figure 11:
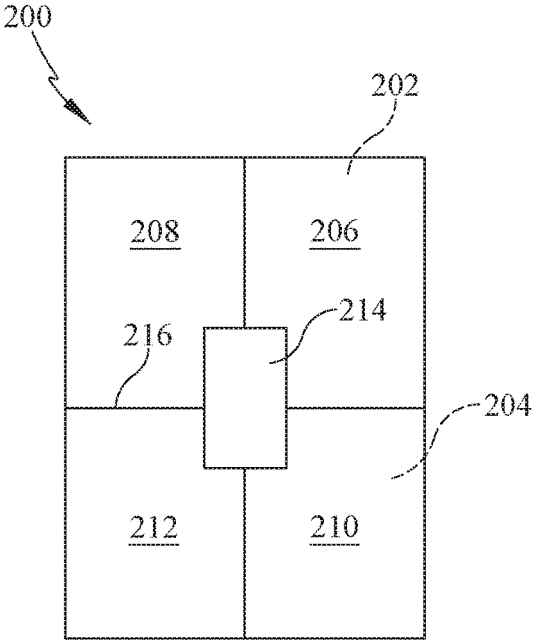
FIG. 11 is a functional front elevational view illustrating a bottom mount refrigerator utilizing an icemaking console that additionally extends into a freezer compartment consistent with some embodiments of the invention.

As shown in FIG. 11, an icemaking console may not only extend into a fresh food compartment, but also into a freezer compartment. Doing so, for example, may assist in positioning an ice and water dispenser at a more convenient height. Thus, as shown in FIG. 11, a bottom mount refrigerator 200 may include a fresh food compartment 202 at a higher elevation than a freezer compartment 204, with each compartment 202, 204 covered by a pair of French doors 206, 208 and 210, 212. An icemaking console 214 extends upwardly from a dividing wall 216 separating the fresh food and freezer compartments. Dividing wall 216 functions as both a bottom wall for fresh food compartment 202 and a top wall for freezer compartment 204, and in this embodiment, console 214 not only extends upwardly but also extends downwardly from dividing wall 216 a portion of the height of the freezer compartment. Moreover, at least a portion of the console (and if included, an ice and/or water dispenser) is disposed below the bottom edges of the fresh food doors 206, 208. Furthermore, in this embodiment, cut-outs are provided on each of doors 206, 208, 210, 212.

Other variations will be appreciated by those of ordinary skill in the art having the benefit of the instant disclosure. Therefore, the invention is not limited to the particular console designs described herein.

Icemaking System

Figure 12:
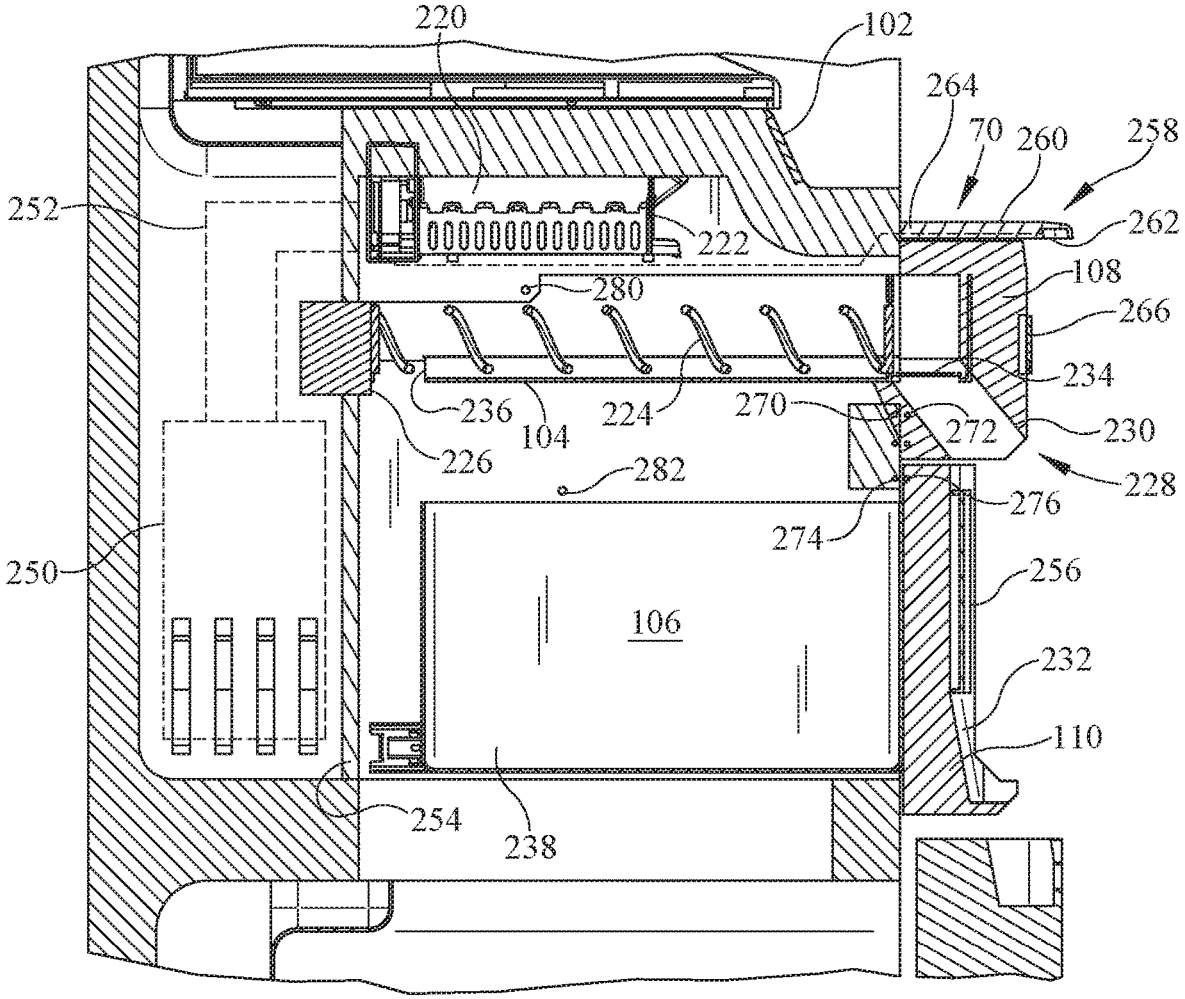
FIG. 12 is a side cross-sectional view of the icemaking console in the refrigerator of FIG. 1.
Figure 13:
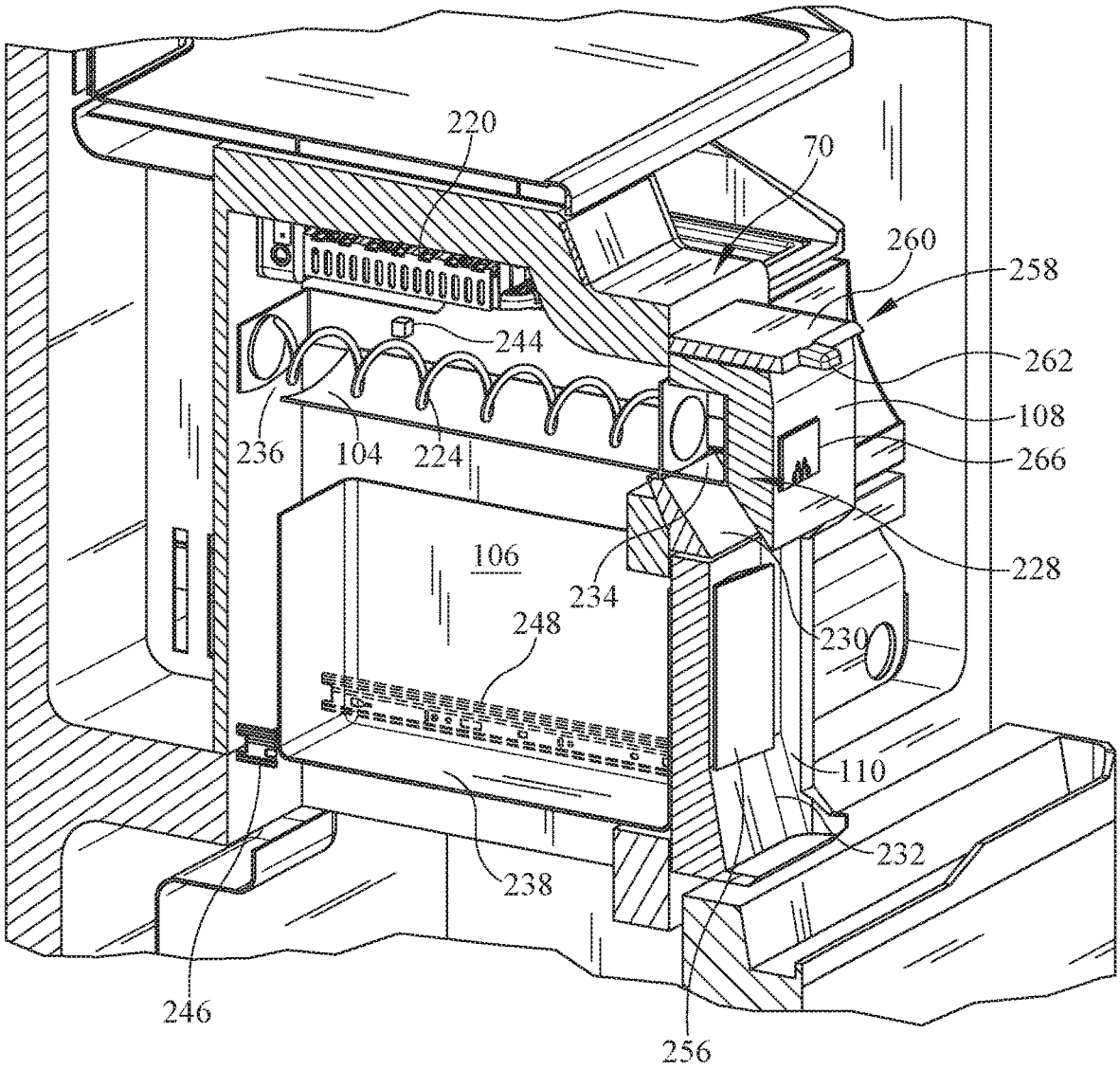
FIG. 13 is a perspective cross-sectional view of the icemaking console in the refrigerator of FIG. 1.
Figure 14:
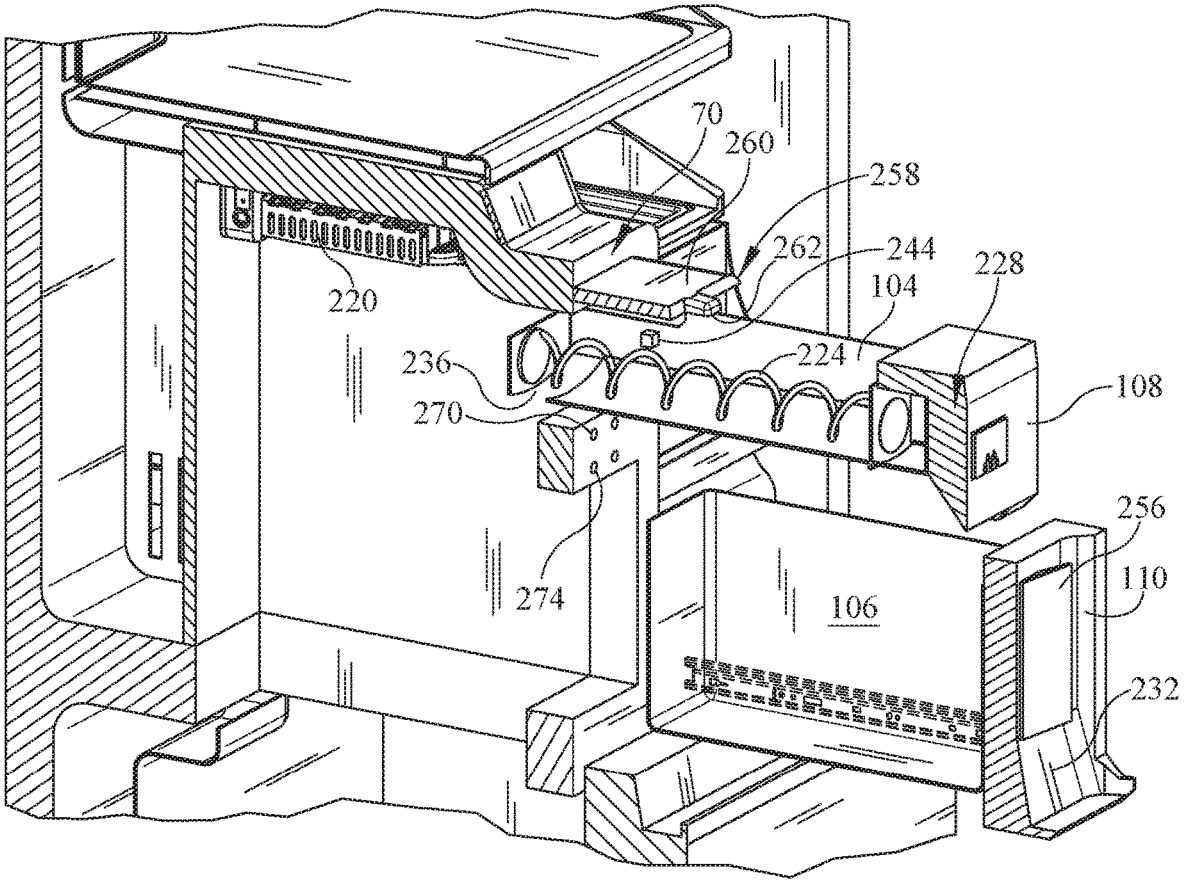
FIG. 14 is a perspective cross-sectional view of the icemaking console in the refrigerator of FIG. 1, with the upper and lower ice storage bins pulled to open positions.

Now turning to FIGS. 12-14, some embodiments of the invention may include an icemaking system incorporating a pair of tandem ice storage bins as well as a removable dispenser recess portion consistent with this invention. The icemaking system may include an icemaker 220 disposed within cabinet 12, and in particular, within icemaking console 70, e.g., proximate a top of the icemaking console. Produced ice is ejected out of a front end 222 of icemaker 220 and drops into an intermediate area of upper ice storage bin 104, which is disposed below icemaker 220 and configured to receive ice produced by the icemaker. It will be appreciated that various icemaker designs may be used in the alternative, including icemakers capable of producing different shapes and/or quantities of ice, icemakers that rotate to dump ice into a storage bin, etc. Further, while icemaker 220 extends generally from front to back within console 70, in other embodiments icemaker 220 may extend transversely (i.e., from side to side). Therefore, the invention is not limited to the particular icemaker design illustrated herein.

Upper ice storage bin 104 also includes a reversible ice mover 224. Ice mover 224 may be driven by a motor 226 or other drive, which in the illustrated embodiment is external to upper ice storage bin 104 and removably and mechanically coupled to ice mover 224 to drive ice mover 224 in two opposing directions when upper ice storage bin 104 is in an operating position, but to separate from the upper ice storage bin when the upper ice storage bin is slid outwardly from console 70. In other embodiments, an ice mover drive may be incorporated into upper ice storage bin 104 itself, and may be removable from refrigerator 10 along with the upper ice storage bin.

Ice mover 224 in the illustrated embodiment may be configured as an auger. In other embodiments, however, ice mover 224 may be configured as a conveyor, a paddle, or other suitable component. Moreover, while no ice crusher is specifically illustrated in the figures, it will be appreciated that various types of ice crusher configurations may be used, and may provide selective crushing of ice dispensed by the icemaking system.

As noted above, ice mover 224 is reversible, and in this regard, may be actuated to push ice disposed in upper ice storage bin 104 in two opposing directions. In a first, forward direction, ice mover 224 pushes ice towards an ice dispenser 228, which in the illustrated embodiment includes portions disposed on each of the front faces 108, 110 of upper and lower ice storage bins 104, 106. Specifically, ice mover 224 may be configured to push ice towards the front of refrigerator 10, and towards an ice chute 230 disposed in front face 108 of the upper ice storage bin. Doing so causes ice (cubed or crushed) to fall through the ice chute and into a container positioned within a dispenser recess portion 232 defined on front face 110 of lower ice storage bin 106. In some embodiments, a flap 234 or other closure may also be provided proximate ice chute 230 to provide some insulation for the ice chute and reduce heat loss from icemaking console 70.

In a second, rearward direction, ice mover 224 pushes ice away from ice dispenser 228, and towards a rearwardly-disposed aperture 236 formed in upper ice storage bin at an opposite end from ice dispenser 228 such that ice pushed into aperture 236 drops into lower ice storage bin 106 positioned below upper ice storage bin 104. While aperture 236 is illustrated as being formed in a bottom wall of upper ice storage bin 104, aperture 236 may alternatively be disposed elsewhere, e.g., on an end or side wall of upper ice storage bin 104. Moreover, while aperture 236 is illustrated as being always open, in other embodiments a movable closure element such as a hinged or sliding trap door may be used, e.g., so that aperture 236 is closed when upper ice storage bin 104 is removed from icemaking console 70. For example, in some embodiments aperture may be normally closed but opened when ice mover 224 is pushing ice in the second, rearward direction.

Figure 15:
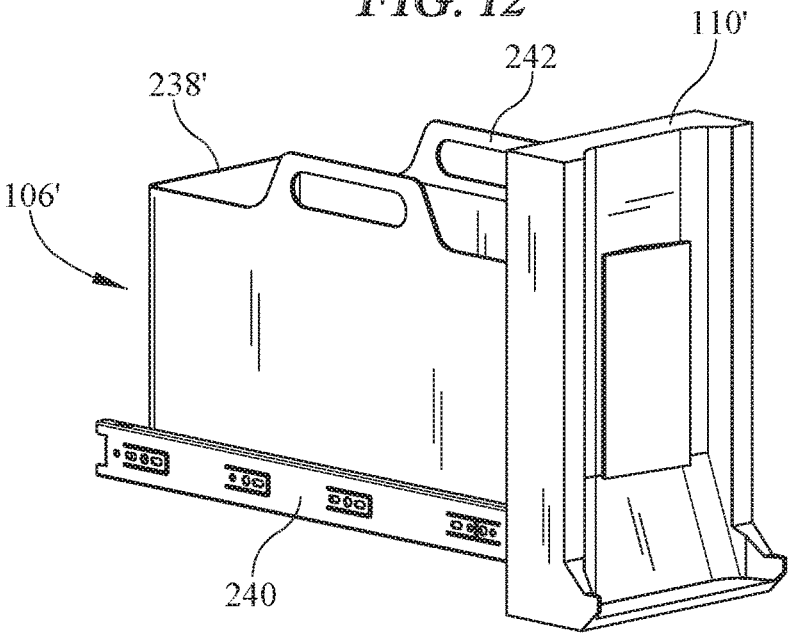
FIG. 15 is a perspective view of an alternate lower ice storage bin to that illustrated in FIG. 4.

Lower ice storage bin 106 in the embodiment illustrated in FIGS. 12-14 includes an ice bucket 238 that is fastened or otherwise secured to front face 110. In other embodiments, however, and as illustrated in FIG. 15, a lower ice storage bin (e.g., lower ice storage bin 106') may include a removable ice bucket 238' that rests on a base 240 that is fastened or otherwise secured to a front face 110'. In some embodiments, an ice bucket may also include one or more handles, e.g., handles 242 of ice bucket 238', that facilitate carrying the ice bucket when loaded down with ice. Ice bucket 238' may be removed, for example, by first sliding lower ice storage bin 106' out of icemaking console 70 and then lifting the ice bucket out of the lower ice storage bin.

Returning to FIGS. 12-14, and with particular reference to FIG. 14, in the illustrated embodiment both of upper and lower ice storage bins 104, 106 are removable from icemaking console 70. In some embodiments upper and lower ice storage bins 104, 106 are both fully removable, while in other embodiments one or both of upper and lower ice storage bins 104, 106 may be only partially removable, e.g., to provide access to the ice stored therein, but without fully disengaging from icemaking console 70. Also, as noted above both ice storage bins may share the same front face, and may be removable together. Further, in some embodiments, a stop, tab or latch (e.g., stop 244 for upper ice storage bin 104) may be provide on either or both of upper and lower ice storage bins 104, 106 to enable upper and lower ice storage bins 104, 106 to be withdrawn at most a predetermined amount from icemaking console 70, but thereafter allow the upper and lower ice storage bins 104, 106 to be fully withdrawn after actuation of the stop.

In one example embodiment, for example, lower ice storage bin 106 may be used as a primary ice storage bin from which a user may obtain ice when a large quantity of ice is needed by the user. The lower ice storage bin 106 may lack a stop and thus may be easily removed from icemaking console 70, even when doors 18, 20, 22 and 24 are all closed. Upper ice storage bin 104, in contrast, may be primarily used to hold ice for dispensing purposes, and thus may not be frequently removed from icemaking console 70 by a user. The upper ice storage bin, however, also provides access to ice mover 224 and icemaker 220, and thus in the event of an obstruction or other issue that may inhibit the production, dispensing and/or storage of ice, the upper ice storage bin may be removed to enable a user to clear any obstructions. In this regard, upper ice storage bin 104 may include stop 244 such that it is not fully removed by a user in most circumstances, yet is still fully removable through actuation of stop 244, e.g., for use by service personnel or when wider access to the upper area of the icemaking console is needed or desired.

Each of upper and lower ice storage bins 104, 106 may be configured to be slidably removed from icemaking console 70, either with or without the use of slide rails or other tracking guides. In the embodiment of FIGS. 12-14, for example, upper ice storage bin 104 lacks any tracking guides, while lower ice storage bin 106 slides along slide rails 246, 248. In other embodiments, other configurations may be used, and moreover, ice storage bins may be mounted for other movement relative to icemaking console 70 in other embodiments, e.g., through rotation or some combination of linear and rotational movement, and through openings in other walls of the icemaking console.

In addition, as discussed above, housing 98 in some embodiments provides additional space within fresh food compartment, e.g., for a fresh food, freezer, or other evaporator, a fan, a compressor, or other cooling system component, for control electronics, or for other purposes. The interior of housing 98 may insulated from fresh food compartment in some embodiments, or may be in fluid communication with the fresh food compartment via vents. In other embodiments, housing 98 may be omitted, and console 70 may extend all of the way to back wall 96. In some embodiments, and as shown in dashed lines in FIG. 12, an evaporator 250 for fresh food compartment 14 may be disposed within housing 98. Further, it may be desirable in some embodiments to route one or more cooling tubes 252 to icemaker 220 to provide direct cooling of the icemaker using the fresh food evaporator. The cooling tubes 252 may extend through an interior wall 254 of console 70 that insulates console 70 from housing 98. In embodiments where housing 98 is omitted, an evaporator may be disposed within console 70, rather than behind console 70 as is the case in FIG. 12. It will be appreciated that by placing fresh food evaporator 250 either within or behind console 70, additional space on the back wall of the fresh food compartment is available, thereby enabling the fresh food compartment to be deeper than would otherwise be possible with the evaporator spread across the back of the cabinet, and thereby increasing the capacity of refrigerator 10.

Turning now with particular reference to FIG. 13, refrigerator 10 includes ice and water dispensing functionality. In this regard, at least portions of ice dispenser 228 are formed by front faces 108, 110 of upper and lower ice storage bins 104, 106, with front face 108 housing ice chute 230 and flap 234, and front face 110 housing a dispenser recess portion 232. Dispenser recess portion 232 is recessed relative to ice chute 230 such that a container (e.g., a cup, glass, bowl, bucket, cooler, etc.) placed into dispenser recess portion 232 will be aligned with ice chute 230 to receive ice dispensed by ice dispenser 228. Moreover, dispenser recess portion may also include one or more ice dispenser controls 256 for actuating ice dispenser 228. In the embodiment shown in FIG. 13, for example, a single ice dispenser control 256 configured as a paddle may be used in dispenser recess portion 232, and may be actuated by a user's finger or by pressing a container against the paddle. In some instances, a separate control or setting may be used to select from between cubed and crushed ice, or in some instances, two paddles or other controls may be used to separately dispense cubed and crushed ice.

In addition to ice dispenser 228, refrigerator 10 also includes a water dispenser 258 disposed on icemaking console 70. Water dispenser 258, as with ice dispenser 228, is externally-accessible when doors 18, 20, 22, and 24 are closed. Unlike ice dispenser 228, however, water dispenser 258 is disposed at a fixed location in icemaking console 70, e.g., on a cantilevered extension 260 having a profile that conforms with front face 108 of upper ice storage bin 104. Water dispenser 258 includes an outlet 262 coupled to a supply line 264, and further includes a valve (not shown) that controls the supply of water to outlet 262. A water dispenser control 266, e.g., a paddle or button, may be disposed underneath outlet 262, e.g., on front face 108 of upper ice storage bin 104, may be used to selectively actuate water dispenser 258 either through pressing by a user's finger or by pressing the edge of a container against the control.

By providing at least the water supply and outlet of water dispenser 258 on a fixed component of refrigerator 10, no detachable couplings or flexible hoses are needed in order to support movement of the water dispenser relative to icemaking console 70. In addition, since at least outlet 262 of water dispenser 258 is separate from ice dispenser 228, ice storage bins 104, 106 are readily removable without concern for the water supply to water dispenser 258.

It will be appreciated, however, that other dispenser configurations may be used in other embodiments. In some embodiments, for example, ice and water may be dispensed from the same dispenser recess portion, and in some instances using the same control (e.g., where a separate dispenser mode switch is used to select between ice, water, and in some instances, crushed ice). Further, different dispenser controls may be used in other embodiments, e.g., various combinations of buttons, paddles, proximity sensors, mode switches, etc. In addition, in other embodiments the various components of the ice and/or water dispensers may be disposed on removable or fixed components in refrigerator 10. Therefore, the invention is not limited to the particular configuration disclosed herein.

In addition, given that controls 256, 266 are disposed on removable components (upper and lower ice storage bins 104, 106), it may be desirable in some embodiments to include a dispenser shut off circuit for one or both of the ice dispenser 228 and water dispenser 258 in response to movement of either of upper and lower ice storage bins 104, 106 away from an operating position. In some embodiments, for example, a dispenser shut off circuit may include one or more switches (e.g., contact switches, magnetic switches, etc.) that disconnect controls 256, 266 from controller 40 when an upper and/or lower ice storage bin 104, 106 is moved away from the operating position.

As shown in FIGS. 12 and 14, for example, a contact switch 270 may be disposed on a front face of icemaking console 70 to contact a contact pad 272 disposed on a rearwardly-facing surface of front face 108 of upper ice storage bin 104 when upper ice storage bin 104 is pushed back into an operating position. Likewise, a second contact switch 274 may be disposed on a front face of icemaking console 70 to contact a contact pad 276 disposed on a rearwardly-facing surface of front face 110 of lower ice storage bin 106 when lower ice storage bin 106 is pushed back into an operating position.

Controller 40 may be configured to deactivate ice and/or water dispenser 228, 258 whenever one or both of upper and lower ice storage bins 104, 106 have been pulled away from icemaking console 70. For example, it may be desirable in some instances to disable both dispensers in response to either ice storage bin 104, 106 being out of an operating position.

In some embodiments, control signals generated by controls 256, 266 may be passed through contact switches 270, 274 and contact pads 272, 276. In other embodiments, separate electrical contacts or wiring may be used to communicate control signals. In addition, while contact switches are illustrated as being located on surfaces that are generally transverse to the sliding axes of ice storage bins 104, 106, in other embodiments the contact switches may be disposed on surfaces that are generally parallel to the sliding axes, or in other locations suitable for detecting the presence of an ice storage bin in an operating position. Moreover, while electrical contact switches are illustrated in FIGS. 12 and 14, in other embodiments other types of switches may be used, e.g., magnetic switches, mechanical switches, optical switches, etc. Further, while in the illustrated embodiment controls 256, 266 include electrical switches that close upon actuation, in other embodiments electrical switches may be disposed in icemaking console and mechanical linkages may be coupled to each control 256, 266 to depress the electrical switches only when ice storage bins 104, 106 are in an operating position. Other manners of coupling controls 256, 266 to controller 40 and/or of disabling the ice and/or water dispensers 228, 258 upon removal of one or both of upper and lower ice storage bins 104, 106 will be apparent to those of ordinary skill having the benefit of the instant disclosure.

Control of ice production with icemaker 220 may be based in part on the sensed level of ice in each of upper and lower ice storage bins 104, 106. In some embodiments, for example, an upper level sensor 280 and a lower level sensor 282 may be configured to sense the level of ice within each of upper and lower ice storage bins 104, 106. Level sensors 280, 282 may be configured as optical or photoelectric sensors, although other sensors may be used in other embodiments, e.g., weight sensors, or sensor arrays capable of sensing ice level at multiple locations in each ice storage bin.

Figure 16:
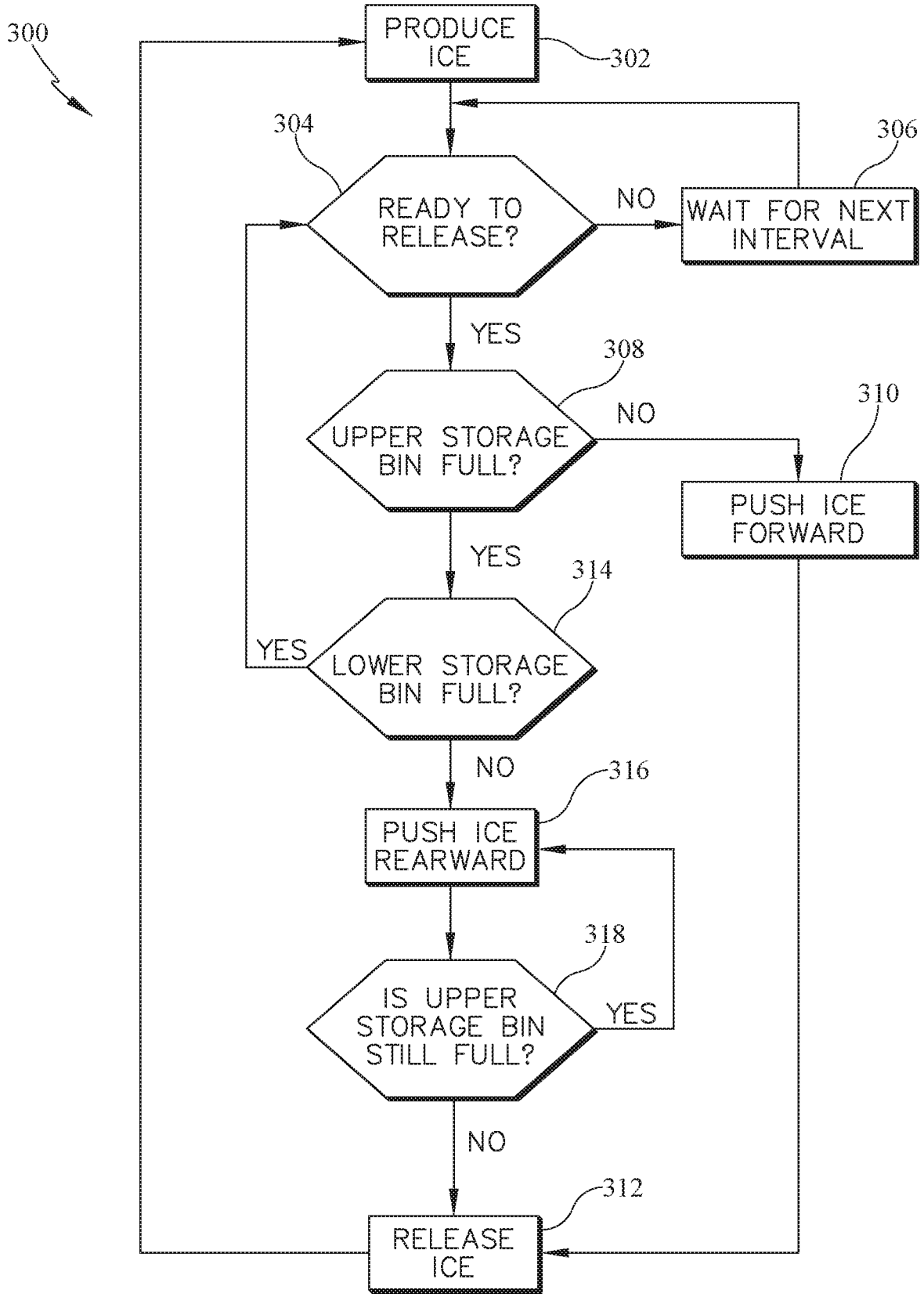
FIG. 16 is a flowchart illustrating a sequence of operations for making ice in the refrigerator of FIG. 1.

As shown in FIG. 16, controller 40 may implement a sequence of operations 300 for producing ice and storing the ice in the upper and lower ice storage bins 104, 106. Starting in block 302, an ice production operation, using any of various known icemaking techniques, may be initiated. Block 304 may then determine whether the icemaker is ready to release the ice, and if not, passes control to block 306 to wait for a next interval before returning control to block 304 to again check if the icemaker is ready to release the ice.

Once the ice production process is complete and the icemaker is ready to release the ice, block 304 passes control to block 308 to determine (e.g., from sensor 280) whether the upper storage bin is full. If not, control passes to block 310 to operate ice mover 224 in the forward direction a predetermined amount to push ice forward towards dispenser 228. By pushing ice forward, the ice may be positioned proximate dispenser 228 to reduce the amount of time ice mover 224 needs to be actuated before ice is dispensed to a user. Control then passes to block 312 to release the ice, thereby dropping the ice into the upper ice storage bin 104. Control then returns to block 302 to initiate another ice production operation.

Returning to block 308, if the upper storage bin is determined to be full, block 308 instead passes control to block 314 to determine (e.g., using sensor 282) whether the lower ice storage bin is full. If so, control returns to block 304 to wait until the upper storage bin is no longer full (e.g., after a user has dispensed some ice using the ice dispenser), such that the produced ice is retained in the icemaker, and no additional ice is produced, until sufficient room exists in the upper ice storage bin.

Returning to block 314, if the lower storage bin is determined to not be full, block 314 passes control to block 316 to operate ice mover 224 in the opposite, rearward direction a predetermined amount to push ice rearward so that at least some of the ice will drop into lower ice storage bin 106. Block 318 then determines if the upper storage bin is still full, and if so, returns control to block 316 to continue pushing ice rearward and thus from the upper ice storage bin to the lower ice storage bin. Once the upper ice storage bin is no longer full, block 318 then passes control to block 312 to release the ice, and then to block 302 to initiate another ice production operation.

Other manners of managing ice production will be apparent to those of ordinary skill having the benefit of the instant disclosure, so the invention is not limited to the particular ice production management disclosed herein.

It will be appreciated that various additional modifications may be made to the embodiments discussed herein, and that a number of the concepts disclosed herein may be used in combination with one another or may be used separately. For example, an icemaking console consistent with the invention may be used in connection with other icemaking systems in other embodiments, and conversely, an icemaking system consistent with the invention may be used in other refrigerator designs, including those without an icemaking console and/or those in which an icemaking system is at least partially disposed elsewhere in a fresh food compartment, a freezer compartment, or door of a refrigerator. Furthermore, an icemaking system consistent with the invention may incorporate tandem ice storage bins without a removable dispenser recess portion in some embodiments, or alternatively, a removable dispenser recess portion without tandem ice storage bins. Therefore, the invention lies in the claims hereinafter appended.

What is claimed is:

1. A refrigerator, comprising:

a cabinet including one or more food compartments;

one or more doors coupled to the cabinet and configured to provide access to the one or more food compartments;

an icemaker disposed within the cabinet;

a storage bin disposed within the cabinet and configured to receive and store ice produced by the icemaker, the storage bin including an externally-accessible front face and an ice bucket disposed rearwardly from the externally-accessible front face; and an externally-accessible ice dispenser configured to dispense ice produced by the icemaker when the one or more doors are closed, wherein the externally-accessible ice dispenser includes an ice mover disposed below the icemaker and configured to convey ice produced by the icemaker to an ice chute and a dispenser recess portion disposed on the front face of the storage bin and below the ice chute to receive a container to which ice may be dispensed, wherein the storage bin and the dispenser recess portion thereof are removably mounted within the cabinet for removal from the cabinet when the one or more doors are closed to provide external access to the ice bucket when the one or more doors are closed and while the ice mover remains within the cabinet, and wherein a top of the ice bucket is disposed below the ice mover when the storage bin is disposed within the cabinet.

2. The refrigerator of claim 1, wherein the storage bin and the dispenser recess portion thereof are slidably mounted within the cabinet.

3. The refrigerator of claim 1, further comprising an externally-accessible water dispenser coupled to a water supply and positioned to dispense water from the water supply through an outlet and into a container positioned below the outlet when the one or more doors are closed.

4. The refrigerator of claim 3, wherein the outlet of the externally-accessible water dispenser is fixedly mounted to the cabinet such that the outlet of the externally-accessible water dispenser remains in a fixed location on the cabinet when the dispenser recess portion is removed from the cabinet.

5. The refrigerator of claim 4, wherein the externally-accessible water dispenser includes a user control configured to actuate the externally-accessible water dispenser.

6. The refrigerator of claim 5, wherein the user control of the externally-accessible water dispenser is removably mounted within the cabinet.

7. The refrigerator of claim 1, wherein the externally-accessible ice dispenser includes a user control configured to actuate the externally-accessible ice dispenser.

8. The refrigerator of claim 7, wherein the user control of the externally-accessible ice dispenser is mounted to the dispenser recess portion and is removable from the cabinet with the dispenser recess portion.

9. The refrigerator of claim 7, wherein the user control comprises a paddle.

10. The refrigerator of claim 7, further comprising a dispenser shut off circuit configured to deactivate the externally-accessible ice dispenser in response to removal of the dispenser recess portion from the cabinet.

11. The refrigerator of claim 10, further comprising a controller, wherein the dispenser shut off circuit includes at least one magnetic switch that disconnects the user control from the controller when the dispenser recess portion is removed from the cabinet.

12. The refrigerator of claim 10, further comprising a controller, wherein the dispenser shut off circuit includes at least one contact switch that disconnects the user control from the controller when the dispenser recess portion is removed from the cabinet.

13. The refrigerator of claim 1, wherein the storage bin is a second storage bin, wherein the refrigerator further comprises:

a first storage bin disposed above the second storage bin and below the icemaker to receive ice produced by the icemaker, wherein the ice mover is disposed within the first storage bin.

14. The refrigerator of claim 13, wherein the first and second storage bins are removable.

15. The refrigerator of claim 14, wherein the ice bucket is removable from the second storage bin.

16. The refrigerator of claim 15, wherein the ice bucket includes at least one handle.

17. The refrigerator of claim 14, wherein the first and second storage bins are slidably removable.

18. The refrigerator of claim 17, further comprising at least one stop configured to restrict removal of the first storage bin beyond a stop position, and wherein the first storage bin is configured to provide access to the icemaker and the ice mover to clear an obstruction.

19. The refrigerator of claim 13, wherein the ice mover is reversible and operable to move ice in first and second directions within the first storage bin, wherein movement of the ice mover in the first direction moves ice to the ice chute and movement of the ice mover in the second direction drops ice from the first storage bin and into the second storage bin.

20. The refrigerator of claim 19, wherein the ice mover comprises an auger or a conveyor.

21. The refrigerator of claim 19, wherein the first storage bin includes an aperture disposed proximate an opposite end of the first storage bin from the ice chute such that ice moved in the second direction by the reversible ice mover falls into the second storage bin through the aperture.

22. The refrigerator of claim 21, wherein the aperture is disposed in a bottom wall, a side wall, or an end wall of the first storage bin.

23. The refrigerator of claim 19, wherein the icemaker extends generally from front to back within the cabinet, wherein the ice dispenser is disposed on a front of the refrigerator, wherein the ice mover moves ice in a generally forward direction when moving ice to the ice dispenser, and wherein the reversible ice mover moves ice in a generally rearward direction when moving ice to the second storage bin.

24. The refrigerator of claim 19, further comprising a controller coupled to the ice mover and a level sensor configured to sense a level of ice within the first storage bin, wherein the icemaker is positioned to drop ice into an intermediate area of the first storage bin, and wherein the controller is configured to:

upon detecting a not full condition in the first storage bin with the level sensor, operate the ice mover to move ice dropped into the intermediate area of the first storage bin in the first direction toward the ice dispenser; and upon detecting a full condition in the first storage bin with the level sensor, operate the ice mover to move ice in the first storage bin in the second direction and into the second storage bin.

25. The refrigerator of claim 24, further comprising a second level sensor configured to sense a level of ice within the second storage bin, wherein the controller is further configured to inhibit a release of ice by the icemaker upon detecting a full condition in the first and second storage bins with the first and second level sensors.

26. The refrigerator of claim 19, wherein the first storage bin is slidably mounted within the cabinet for withdrawal from the cabinet when the one or more doors are closed.

27. The refrigerator of claim 1, wherein the one or more food compartments includes a freezer compartment and a fresh food compartment, wherein the fresh food compartment is disposed in the cabinet above the freezer compartment and has a top wall, a bottom wall, and first and second side walls, wherein the bottom wall separates the fresh food compartment from the freezer compartment, wherein the refrigerator further comprises an icemaking console extending upwardly from the bottom wall of the fresh food compartment only a portion of a height of the fresh food compartment and spaced apart from each of the top wall, the first side wall, and the second side wall, wherein the icemaking console includes one or more walls that insulate an interior compartment of the icemaking console from the fresh food compartment, and wherein the icemaker, the externally-accessible ice dispenser, and the dispenser recess portion are disposed within the icemaking console.

28. A refrigerator, comprising:

a cabinet including one or more food compartments;

one or more doors coupled to the cabinet and configured to provide access to the one or more food compartments;

an icemaker disposed within the cabinet;

an externally-accessible ice dispenser configured to dispense ice produced by the icemaker when the one or more doors are closed, wherein the externally-accessible ice dispenser includes an ice mover disposed below the icemaker and configured to convey ice produced by the icemaker to an ice chute and a dispenser recess portion disposed below the ice chute to receive a container to which ice may be dispensed, wherein the dispenser recess portion is supported by the cabinet such that the dispenser recess portion remains in a fixed location on the cabinet when any of the one or more doors is opened, and wherein the dispenser recess portion is removably mounted within the cabinet for removal from the cabinet when the one or more doors are closed; and a storage bin disposed below the icemaker and configured to receive ice produced by the icemaker, the storage bin including an externally-accessible front face and an ice bucket disposed rearwardly from the externally-accessible front face, wherein the dispenser recess portion is disposed on the front face of the storage bin such that removal of the dispenser recess portion from the cabinet additionally removes the storage bin from the cabinet, wherein the ice bucket is disposed below the ice mover when the storage bin is disposed within the cabinet, and wherein a top of the ice bucket is open such that removal of the storage bin from the cabinet provides external access to the ice bucket through the open top thereof.

29. The refrigerator of claim 28, further comprising an externally-accessible water dispenser coupled to a water supply and positioned to dispense water from the water supply through an outlet and into a container positioned below the outlet when the one or more doors are closed, wherein the outlet of the externally-accessible water dispenser is fixedly mounted to the cabinet such that the outlet of the externally-accessible water dispenser remains in a fixed location on the cabinet when the dispenser recess portion is removed from the cabinet.

30. The refrigerator of claim 29, wherein the externally-accessible water dispenser includes a user control configured to actuate the externally-accessible water dispenser, and wherein the user control of the externally-accessible water dispenser is removably mounted within the cabinet.

31. The refrigerator of claim 29, wherein the one or more food compartments includes a freezer compartment and a fresh food compartment, wherein the fresh food compartment is disposed in the cabinet above the freezer compartment and has a top wall, a bottom wall, and first and second side walls, wherein the bottom wall separates the fresh food compartment from the freezer compartment, wherein the refrigerator further comprises an icemaking console extending upwardly from the bottom wall of the fresh food compartment only a portion of a height of the fresh food compartment and spaced apart from each of the top wall, the first side wall, and the second side wall, wherein the icemaking console includes one or more walls that insulate an interior compartment of the icemaking console from the fresh food compartment, and wherein the icemaker, the externally-accessible ice dispenser, and the dispenser recess portion are disposed within the icemaking console.

32. The refrigerator of claim 28, wherein the externally-accessible ice dispenser includes a user control configured to actuate the externally-accessible ice dispenser, wherein the user control of the externally-accessible ice dispenser is mounted to the dispenser recess portion and is removable from the cabinet with the dispenser recess portion, and wherein the refrigerator further comprises a dispenser shut off circuit configured to deactivate the externally-accessible ice dispenser in response to removal of the dispenser recess portion from the cabinet.

33. The refrigerator of claim 28, wherein the storage bin is a second storage bin, wherein the refrigerator further comprises:

a first storage bin disposed above the second storage bin and below the icemaker to receive ice produced by the icemaker, wherein the ice mover is disposed within the first storage bin.

34. The refrigerator of claim 33, wherein the first storage bin is removable from the cabinet to provide access to the icemaker and the ice mover to clear an obstruction.

35. A refrigerator, comprising:

a cabinet including one or more food compartments;

one or more doors coupled to the cabinet and configured to provide access to the one or more food compartments;

an icemaker disposed within the cabinet;

an externally-accessible ice dispenser configured to dispense ice produced by the icemaker when the one or more doors are closed, wherein the externally-accessible ice dispenser includes:

a dispenser recess portion configured to receive a container to which ice may be dispensed, wherein the dispenser recess portion is removably mounted within the cabinet for removal from the cabinet when the one or more doors are closed; and a user control configured to actuate the externally-accessible ice dispenser, wherein the user control of the externally-accessible ice dispenser is mounted to the dispenser recess portion and is removable from the cabinet with the dispenser recess portion; and a dispenser shut off circuit configured to deactivate and disable the externally-accessible ice dispenser in response to removal of the dispenser recess portion from the cabinet.

36. The refrigerator of claim 35, wherein the dispenser shut off circuit is configured to electrically deactivate the externally-accessible ice dispenser in response to removal of the dispenser recess portion from the cabinet.

37. The refrigerator of claim 35, wherein the dispenser shut off circuit includes a switch that is configured to electrically deactivate the externally-accessible ice dispenser responsive to removal of the dispenser recess portion from the cabinet.

* * * * *